US006806468B2

(12) United States Patent
Laiko et al.

(10) Patent No.: US 6,806,468 B2
(45) Date of Patent: Oct. 19, 2004

(54) CAPILLARY ION DELIVERY DEVICE AND METHOD FOR MASS SPECTROSCOPY

(75) Inventors: Victor Laiko, Ellicott City, MD (US); Vladimir Doroshenko, Ellicott City, MD (US)

(73) Assignee: Science & Engineering Services, Inc., Burtonsville, MD (US)

( * ) Notice: Subject to any disclaimer, the term of this patent is extended or adjusted under 35 U.S.C. 154(b) by 625 days.

(21) Appl. No.: 09/795,108

(22) Filed: Mar. 1, 2001

(65) Prior Publication Data

US 2002/0121596 A1 Sep. 5, 2002

(51) Int. Cl.[7] ..... H01J 49/04

(52) U.S. Cl. ..... 250/288; 250/281; 250/282; 250/284; 250/286; 250/287; 250/423

(58) Field of Search ..... 250/281, 284, 250/286, 287, 288, 289, 290, 291, 292, 423, 282, 283, 397, 398, 423 R; 436/153; 73/863.11

(56) References Cited

U.S. PATENT DOCUMENTS

| | | | | |
|---|---|---|---|---|
| 4,551,624 A | * | 11/1985 | Spangler et al. | 250/287 |
| 4,968,885 A | * | 11/1990 | Willoughby | 250/288 |
| 4,977,320 A | | 12/1990 | Chowdhury et al. | |
| 5,071,771 A | * | 12/1991 | Barbour et al. | 436/153 |
| 5,245,186 A | | 9/1993 | Chait et al. | |
| 5,285,064 A | * | 2/1994 | Willoughby | 250/288 |
| 5,644,130 A | * | 7/1997 | Raatz | 250/288 |
| 5,796,099 A | * | 8/1998 | Jackson | 250/286 |
| 5,965,884 A | * | 10/1999 | Laiko et al. | 250/288 |

OTHER PUBLICATIONS

Craig M. Whitehouse, et al., Electrospray Interface for Liquid Chromalographs and Mass Spectrometers, Anal. Chem 1985, vol. 57, No. 3, Mar. 1985, pp. 675–679.

Baiwei Lin et al., Ion Transport by Viscous Gas Flow through Capillaries, J.Am. Soc. for Mass Spectrometry, 1994, vol. 5, pp. 873–885.

E.C. Horning et al., New Picogram Detection System Based on a Mass Spectrometer with an External Ionization Source at Atmospheric Pressure, Anal. Chem. May 1973, vol. 45, No. 6, pp. 936–943.

H.R. Kobraei et al., Formation Energies and Concentrations of Microclusters for Homogeneous Nucleation, J. Chem. Phys. 1988, vol. 88, pp. 4451–4459.

John B. Fenn et al., Electrospray Ionization for Mass Spectrometry of Large Bomolecules, Science, vol. 246, pp. 64–71.

* cited by examiner

*Primary Examiner*—John R. Lee
*Assistant Examiner*—David A. Vanore
(74) *Attorney, Agent, or Firm*—Oblon, Spivak, McClelland, Maier & Neustadt, P.C.

(57) ABSTRACT

A system and method for mass spectrometry in which the system includes at least one ion source which produces ions, a mass spectrometer having an inlet orifice configured to accept the ions, and a capillary ion delivery device which detachably interfaces to the inlet orifice of the mass spectrometer. The method includes producing ions from the ion source, transporting the ions from the ion source to the inlet orifice of the mass spectrometer via the capillary ion delivery device, and mass analyzing the ions in the mass spectrometer.

55 Claims, 7 Drawing Sheets

CAPILLARY ION DELIVERY DEVICE AND METHOD FOR MASS SPECTROSCOPY

BACKGROUND OF THE INVENTION

1. Field of the Invention

The present invention relates to a device, system, and method for delivery of ions from ion sources to a mass spectrometer to perform mass spectroscopy.

2. Discussion of the Background

Ion sources represent an important component of a mass spectrometer (MS). Atmospheric Pressure (AP) ion sources are used in modem analytical mass spectrometry. AP ion sources produce ions under ambient atmospheric conditions outside the vacuum of a mass spectrometer instrument. Atmospheric pressure chemical ionization APCI sources, as described by Bruins, in Mass Spectrom. Rev. 1991, vol. 10, beginning at p. 53, the entire contents of which are incorporated herein by reference, produce ions of volatile analytes with molecular masses 1–150 atomic mass units or Daltons (DA). Electrospray ionization (ESI) sources, as described in Yamashita, et al., J. Chem. Phys. 1984, vol. 88, pp. 4451 and Fenn, et al., Science 1989, vol. 246, p. 64–71, the entire contents of each reference are incorporated herein by reference, are used in analytical biochemistry to transfer heavy molecular ions (with masses up to several hundred thousand Da) intact from a liquid analyte solution to the gas phase for subsequent mass analysis. Further, an atmospheric pressure matrix assisted laser desorption ionization source (AP MALDI), as described in U.S. Pat. No. 5,965,884, the entire contents of which are incorporated herein by reference, produces ions of heavy biomolecules under normal atmospheric pressure conditions by laser irradiation, desorption, and ionization of analyte/matrix solid microcrystals.

AP ion sources are more accessible than "internal" vacuum ion sources. In an AP ion source, sample ionization takes place outside the MS instrument itself The gas/liquid/solid sample delivery (or loading) takes place under normal laboratory atmospheric pressure condition. Ions produced under atmospheric pressure by an AP ion source are introduced into the vacuum chamber of mass spectrometer through an atmospheric pressure interface (API). Typically, the API consists of several stages of differential pumping separated by gas apertures.

In one approach as described in Horning et. al., Anal. Chem. 1973, vol. 455, pp. 936–943, the entire contents of which are incorporated herein by reference, a pinhole orifice in a thin membrane-type flange separates an atmospheric pressure region from an initial vacuum stage of the MS instrument (typically at a pressure of 0.1–5 mTorr). Ions leak through the pinhole into the mass spectrometer.

In another approach, as described in Whitehouse et al., Anal. Chem. 1985, vol. 57, pp. 675–679, the entire contents of which are incorporated herein by reference, an intermediate pumping chamber typically at a pressure of (0.1–5 mTorr) is connected via a capillary tube, typically having an inner diameter of 0.1–1.0 mm. The capillary tube is frequently heated to a temperature of 80–250° C. for ion desolvation. The heated capillary tube delivers atmospheric pressure ions to the vacuum of the mass spectrometer, as described in U.S. Pat. Nos. 4,977,320 and 5,245,186, the entire contents of which are incorporated herein by reference.

A capillary tube can be used in modern commercial and scientific MS instruments. Ions produced at atmospheric pressure can be effectively transported through metal or insulating capillaries as long as 15 meters. Ion diffusion toward the walls of the capillary tube during transport through the tube represents an ion loss factor. However, the transport of heavy ions in capillary tubes is effective because heavy ions, having lower diffusion coefficients than light ions, do not diffuse as rapidly to the walls of the capillary.

Ion losses in a capillary tube depend mainly on the ion residence time inside the capillary. If a gas flow through a capillary is fixed, the loss of ions to the walls of the capillary tube will depend mainly on the capillary length, and not on the capillary diameter. Both metallic and insulating (e.g., glass) capillaries show similar ion transport properties. The process of ion transport by viscous gas flow through capillaries is described in B. Lin and J. Sunner, J. Am. Soc. Mass Spectrom. 1994, vol. 5, pp. 873–885, the entire contents of which are incorporated herein by reference.

FIGS. 1 and 2 represent schematically two APIs for introducing ions from an atmospheric pressure ion source into a mass spectrometer. As shown in these figures, the API can be include either an inlet capillary tube 2 (as shown in FIG. 1) or a pinhole orifice 3 (as shown in FIG. 2). The inlet capillary tube 2 as shown in FIG. 1 is located on a MS inlet flange 4*a*. The pinhole orifice 3 as shown in FIG. 2 is located on a MS inlet flange 4*b*.

In FIG. 1, an electrospray ion (ESI) source 5 is placed into an atmospheric pressure region 6 close to an inlet orifice 7 of the inlet capillary tube 2. The capillary tube 2 is attached to the inlet flange 4*a* of the mass spectrometer. The pressure in vacuum chamber behind the inlet capillary tube 2 is typically 1–5 Torr.

In FIG. 2, the ESI source 5 is placed into the atmospheric pressure region 6 close to the pinhole orifice 3. The pinhole orifice 3 is attached to the inlet flange 4*b* and separates the atmospheric pressure region 6 from a first pumped region 8 behind the inlet flange 4*b*. A skimmer 9 separates the first pumped region 8 from a second pumped region 10. In the second pumped region 10, the pressure is several orders of magnitude lower than in the first pumped region 8. Typically, a gas curtain is used to prevent large droplets from the ESI source from blocking the inlet orifice 3. The gas curtain includes a gas curtain electrode 11. A gas counterflow flows as shown by the arrow in FIG. 2 between the gas curtain electrode 11 and the inlet flange 4*b* restricts large droplets from reaching the pinhole orifice 3. In FIGS. 1 and 2, the ESI source 5 is placed as close as possible to the respective inlet orifices 3 or 7 in order to enhance mass spectrometer ion collection.

Because an atmospheric pressure ion source is an external part of a mass spectrometer, in theory a MS instrument can work with a number of the existing ion sources. However, commercial MS instruments are designed to accommodate only one or two particular ion sources. Usually, commercial MS instruments will accommodate only an ESI or an APCI source. Other atmospheric pressure ion sources such as the AP MALDI source previously noted are not readily accommodated.

As shown in FIG. 3, the AP MALDI source includes a target plate 11, a laser beam 12 which irradiates the target plate 11 via mirror 13 which reflects the irradiated laser beam onto a position of the target plate where desorption and ionization of adsorbed species occurs. A detailed description of an AP MALDI source can be found in U.S. Pat. No. 5,965,884, the entire contents of which has been previously incorporated herein by reference. In FIG. 3, the physical size and geometric arrangement of the laser optics and the size of the target plate 11 do not permit the placement of an AP MALDI source in close proximity to the inlet orifice 7 of the inlet capillary tube 2. U.S. Pat. No. 5,965,884 describes a modification to the API which enables an AP MALDI ion source to interface to a mass spectrometer. In this modification, a flange with an inlet orifice is attached to a mass spectrometer and becomes an integral part of the mass spectrometer instrument. As such, the interchangeability to other atmospheric pressure sources such as ESI and APCI sources is complex and time-consuming. To change the flange requires, venting the mass spectrometer, installing another flange, and evacuating the mass spectrometer back to a low operating pressure.

SUMMARY OF THE INVENTION

In conventional approaches, variations in the pressure and temperature conditions in front of the inlet capillary tube 2 or the pinhole orifice 3 change the transport characteristics into the mass spectrometer and thus change the sensitivity of the mass spectrometer. Thus, one object of the present invention is to provide a device that delivers ions produced from one or more remote ion sources to an inlet orifice of a mass spectrometer in such a way that the delivery does not disturb significantly the physical conditions (pressure, temperature) around the inlet orifice to the mass spectrometer.

Another object of the present invention is to provide a CIDD which can deliver over a determined distance ions produced from various ion sources to an inlet orifice of a mass spectrometer. Further, in one embodiment of the present invention, the CIDD is detachable which enables different ion sources to be attached to the mass spectrometer without disruption to the operation of the mass spectrometer.

Advantageously, the CIDD of the present invention can work at an arbitrary temperature, can support temperature differentials across a longitudinal length, and can support pressure differentials across a longitudinal length of the CIDD.

Thus, it is another object of the present invention to provide a CIDD which permits a higher than atmospheric-pressure source to be coupled to the mass spectrometer without affecting the sensitivity of the mass spectrometer. In the CIDD of the present invention, a stream of gas flows through one or more transport tubes. Ions are transported through the CIDD as a result of a pressure drop between an inlet orifice and a connection port of the CIDD. The pressure differential can be small compared with atmospheric pressure.

Still another object of the present invention is to provide a CIDD which permits desolvation of ions in a heated section of the CIDD prior to arrival of the transported ions to the inlet orifice of the mass spectrometer, and more importantly permits arrival of the ions to the inlet orifice to the mass spectrometer without affecting the standard temperature condition.

Another object of the present invention is to provide a gas switch in the CIDD to enable the mass spectrometer to sample from different ion sources.

Still a further object of the present invention is to deliver ions at an arbitrary temperature including ambient temperature conditions.

Another object of the present invention is to provide a reaction vessel in the CIDD in order to allow chemical mixing and reactions to occur between ions from different ion sources.

These and other objects are achieved in a system and method for mass spectrometry in which the system includes at least one ion source which produces ions, a mass spectrometer having an inlet orifice configured to accept the ions, and a capillary ion delivery device which detachably interfaces to the inlet orifice of the mass spectrometer. The method includes producing ions from the ion source, transporting the ions from the ion source to the inlet orifice of the mass spectrometer via the capillary ion delivery device, and mass analyzing the ions in the mass spectrometer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 4A:
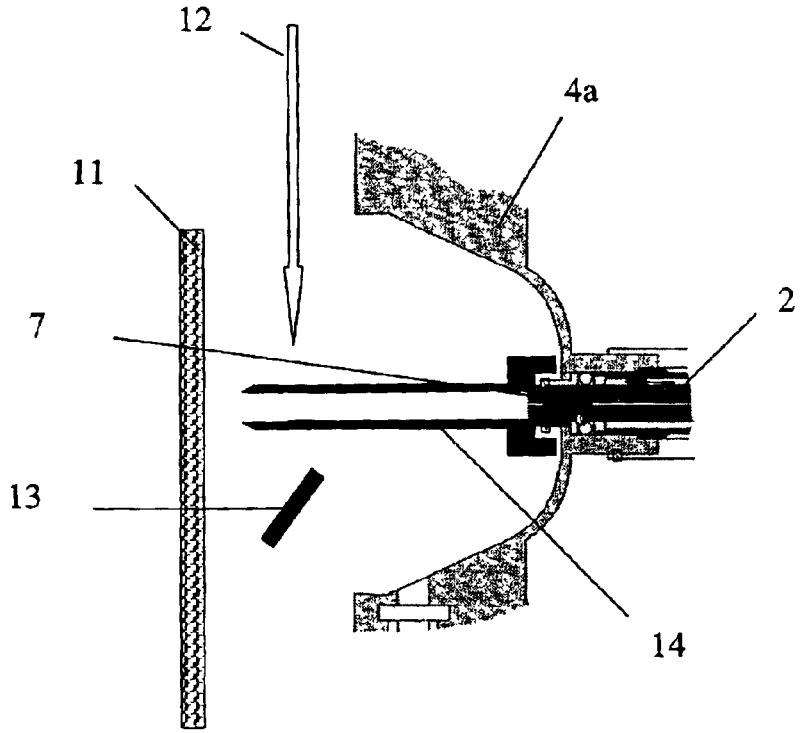
FIG. 4A is a schematic of an AP MALDI source interfaced with a mass spectrometer utilizing a CIDD according to one embodiment of the present invention.

The objects, features and attendant advantages of the present invention will be more fully appreciated as the same becomes better understood from the following detailed description when considered in connection with the accompanying drawings in which like reference characters designate like or corresponding parts throughout the several views and wherein FIG. 4A is a schematic view of an external AP MALDI source interfaced to a mass spectrometer using the CIDD according to one embodiment of the present invention.

Figure 4B:
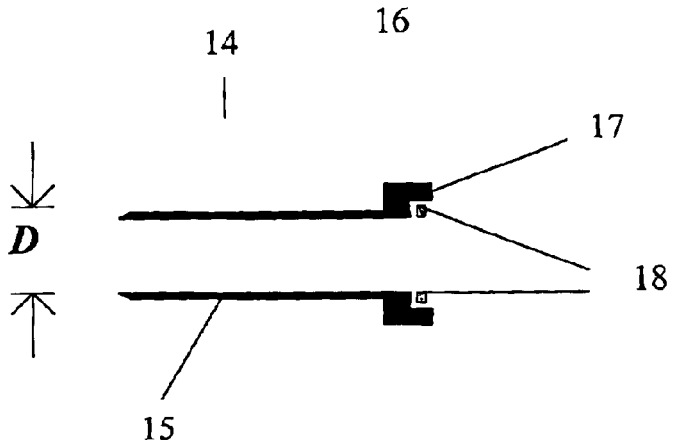
FIG. 4B is a schematic of a detachable CIDD according to one embodiment of the present invention.

The AP MALDI source includes the target plate 11, the laser beam 12, and the mirror 13 which reflects the irradiated laser beam onto the target plate 11 to desorb and ionize species adsorbed on the target plate 11. According to the present invention, the inlet capillary tube 2 is connected to a detachable capillary ion delivery device 14 (CIDD), as shown in FIGS. 4A and 4B. The detachable CIDD 14 is a conduit for transporting ions to the mass spectrometer.

In one embodiment of the present invention, the CIDD 14 includes an inlet port 15, a capillary tube 16, a connection port 17, and a sealing mechanism 18. In a preferred embodiment, the length of the capillary tube 16 is short enough to avoid unnecessary ion loses, taking into account practical demands associated with the chosen ion source and a position of the chosen ion source to an entrance orifice of the mass spectrometer. The capillary tube 16 can be fabricated from a metallic tube such as for example a stainless steel tube. The capillary tube 16 can be attached to the inlet orifice 7 via the connection port 17 which can be for example a stainless steel flange. The sealing mechanism 18 can include a teflon o-ring which fastens to the inlet orifice 7 in a gas tight manner. An attachment mechanism for mounting the CIDD 14 to the inlet flange 4*a* is not shown in FIG. 4A, but can include for example a thread, a spring, or a screw.

In another embodiment, the capillary tube 16 can be insulating. An insulating capillary decouples electrically an ion source from the mass spectrometer and is utilized when an external ion source is under a potential that differs from the potential of the mass spectrometer inlet flange 4*a* or 4*b*.

Implementation of a CIDD, according to the present invention, may vary in some details compared with the schematic presentation in FIG. 4A or 4B. For example, several parts such as for example the connection port 17 and the capillary 15 can include separable parts. The dimensions and shape can vary depending on the details associated with a particular MS instrument. The mass spectrometers used in the present invention can include a time-of-flight mass spectrometer, an ion trap mass spectrometer, an rf quadrupole mass spectrometer, or a magnetic sector mass spectrometer. Other mass spectrometers can also be used within the spirit of the present invention.

Figure 5:
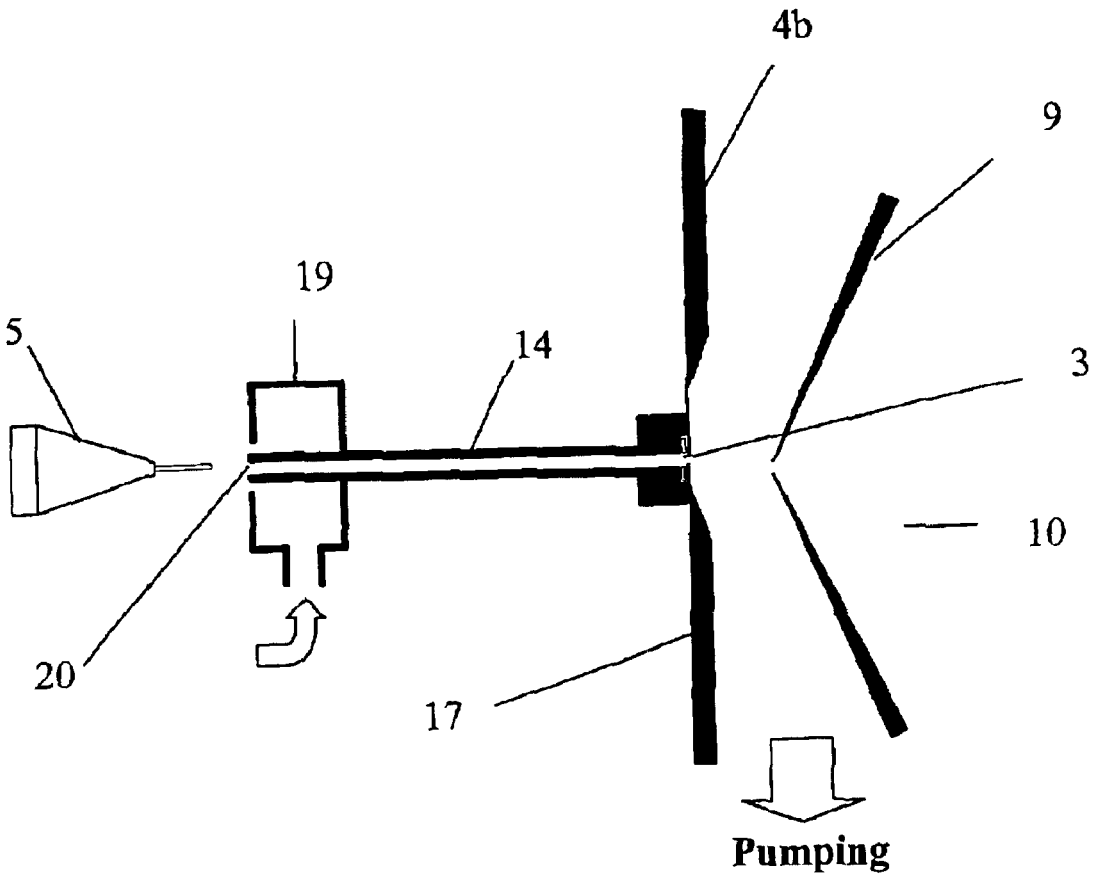
FIG. 5 is a schematic of an ESI source interfaced with a pinhole orifice on an atmospheric pressure interface of a mass spectrometer through an insulating CIDD according to another embodiment of the present invention.

In another embodiment of the present invention, as shown in FIG. 5, the CIDD 14 can be attached to the inlet flange 4*b* defining the pinhole orifice 3. If the CIDD is insulating, the CIDD 14 can be equipped with a metal entry flange 19 to which an electrical potential can be applied. The metal entry flange 19 is adapted to the particular external ion source to be utilized. As shown in FIG. 5, the metal inlet flange 19 can include a gas curtain chamber through which a gas counter flow as shown in FIG. 5 is applied to prevent large uncharged droplets generated by electrospray source 3 from reaching the capillary entrance 20.

If the ions of interest are sufficiently heavy so that the diffusion toward the inner CIDD walls is slow, the CIDD, according to the present invention, can be as long as a few meters with acceptable levels of ion losses. Thus, according to the present invention, remote ion sources can be interfaced with the MS instrument.

The inner diameter of CIDD, according to the present invention, can be optimized by taking into account the operational processes. The API of a commercial MS instrument is typically optimized so that maximum ion flux occurs if the pressure around the inlet orifice is set at 1 atmosphere. If a capillary of improper dimension is attached to the inlet orifice 3 or 7, there is a resultant pressure drop across the capillary as the gas flows into the mass spectrometer, and the pressure at the inlet orifice 3 or 7 of the MS instrument decreases to a sub-atmospheric pressure.

Figure 1:
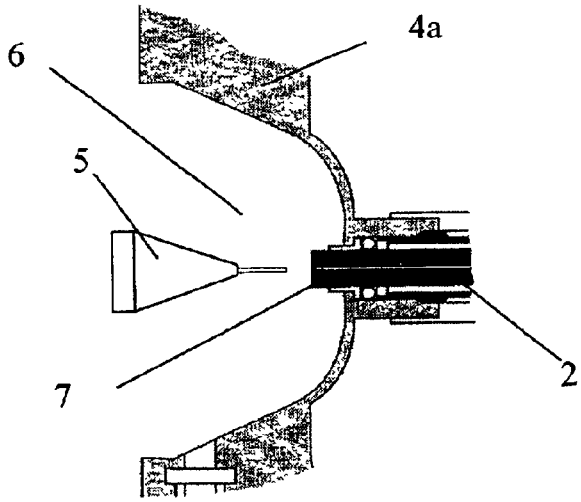
FIG. 1 is a schematic of a mass spectrometer interface with an ESI source coupled to the interface via a capillary tube.
Figure 2:
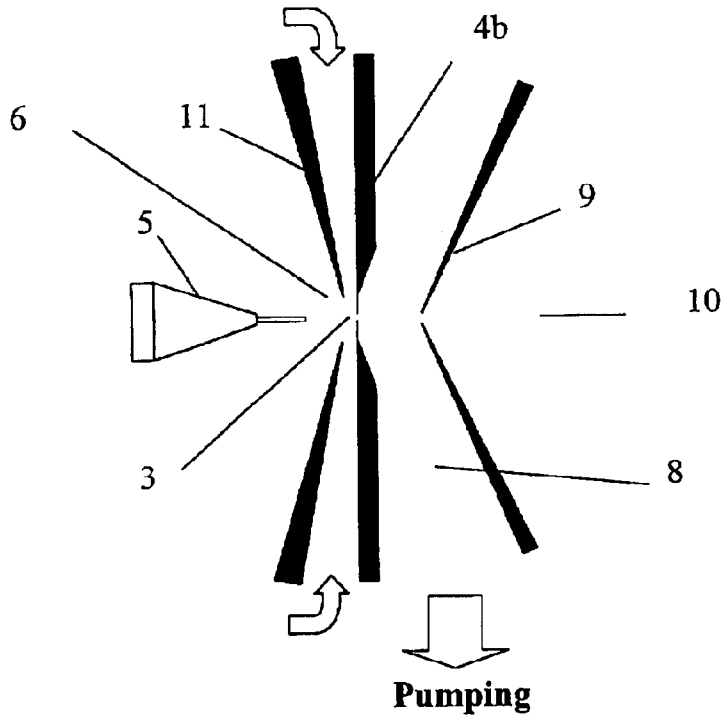
FIG. 2 is schematic of a mass spectrometer interface with an ESI source coupled to the interface via a pinhole orifice.
Figure 3:
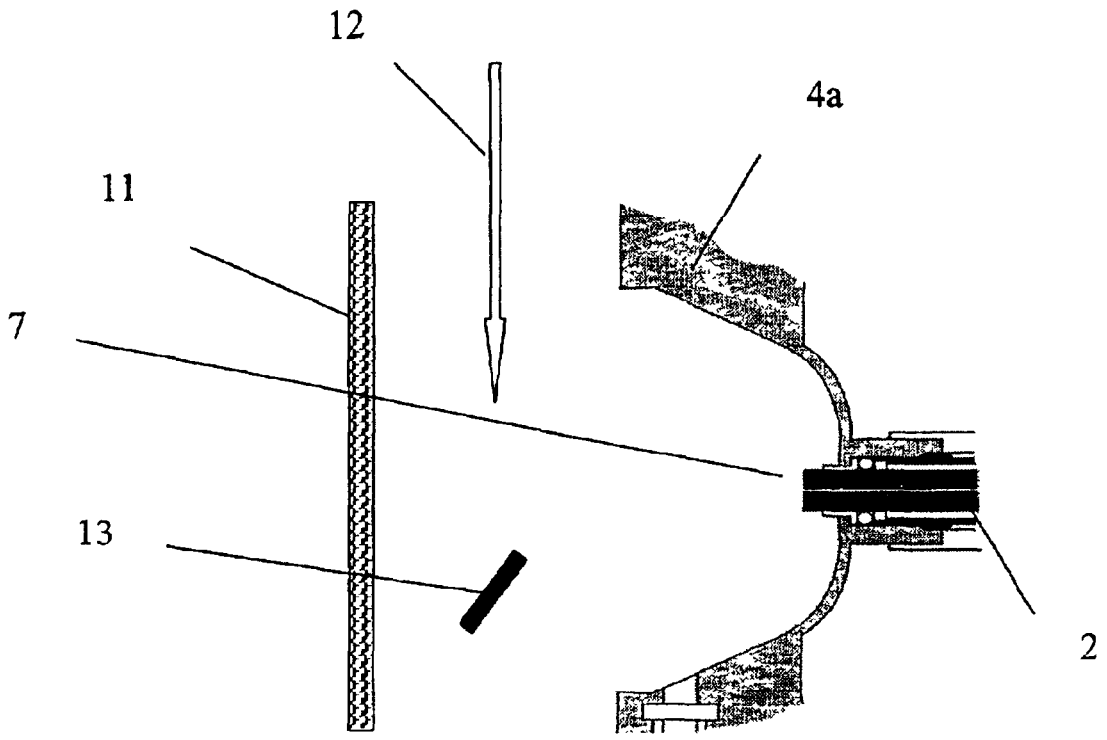
FIG. 3 is a schematic of an AP MALDI source interfaced with a mass spectrometer.

According to the present invention, the pressure drop below atmospheric pressure at the inlet orifice is sufficiently small when the inner diameter D of the CIDD 14 is about 1.5 times larger than that of the inner diameter of the inlet orifice 7 or the pinhole orifice 3. An inner diameter of inlet orifice 7 in FIG. 1 can be 0.5 mm, and an inner diameter for the pinhole orifice 3 in FIG. 2 can be between 0.1–0.3 mm. In another embodiment, the inner diameter D of the CIDD 14 is greater than 1.5 times larger than that of the inner diameter of the inlet capillary tube 2 or the pinhole orifice 3. In a preferred embodiment, the inner diameter D is between 1.5 and 5 times the inner diameter of the inlet capillary tube 2 or the pinhole orifice 3.

For a CIDD of the present invention, a pressure drop along the longitudinal length of the CIDD can be estimated from the following generic parameters associated with an inlet orifice to an atmospheric pressure mass spectrometer having an inlet orifice with an inner diameter of 0.5 mm. For the given length, inner diameter, and throughput below:

L=10 cm (length of the CIDD),

D=0.10 cm (inner diameter of the CIDD);

Q=1L/min=17 $cm^3$/sec–(volumetric gas flow at 1 atm, typical for atmospheric pressure MS instruments), a pressure drop along the longitudinal length of the CIDD is estimated to be less than 0.014 of an atmosphere. Thus, the CIDD of the present invention does not decrease the pressure at the inlet orifice 2 or 3 to a value substantialy below standard atmospheric conditions (i.e. 1 atmosphere or 760 Torr). As previously-noted, deviations from standard pressure and temperature conditions (i.e., 1atm and 300 K) may affect the operation and sensitivity of the mass spectrometer. Accordingly, the CIDD of the present invention introduces ions from remote ion sources to the inlet orifice 2 or 3 of the mass spectrometer such that the ions are introduced near standard conditions of temperature and pressure, such as for example pressures from 0.80 to 1.20 atm and temperatures from 280 to 320 K. These ranges ensure that gas flow into the mass spectrometer varies by no more than about 20%.

Further, the efficiency of ion transmission through the CIDD of the present invention can be estimated. For light ions (i.e., less than 100 Da molecular mass), the above-noted CIDD is calculated to transmit approximately 10% of ions through the CIDD with the gas flow parameters given. For heavier ions, such as for example heavy biological ions, the diffusion towards the capillary wall is slower and the transmission is higher. For example, an ion with a molecular weight of 500 Da would be expected to transmit ~30% of the ions.

In an another embodiment of the present invention, when a small inner diameter CIDD device having a relatively long length is required, the ion source can be pressurized. Pressurization provides a gas pressure differential to exist between the CIDD entrance and the MS instrument inlet orifice to ensure simultaneously viscous gas flow and normal atmospheric pressure at an inlet orifice of the mass spectrometer.

The inlet capillary tube on an API on a conventional MS instrument is typically heated to a temperature of 90–210° C. to assist in the process of desolvation of atmospheric pressure ions. However, according to the present invention, the CIDD of the present invention can be installed in series with a heated transport capillary tube interior to the mass spectrometer. Ions transported through the CIDD of the present invention can arrive at the heated transport capillary tube in a solvated form. Therefore, the operational temperature of CIDD of the present invention according to one embodiment need not be elevated, which simplifies construction and operation of the CIDD. Moreover, transport of solvated ions in the CIDD of the present invention is a preferable method of transporting ions due to the lower diffusion coefficients of the ion/solvent clusters and, as a result, yields better transport efficiency than obtained from transport without a solvent.

On the other hand in another embodiment of the present invention, the temperature of the CIDD 14 or a part of the CIDD 14 can be increased for example to induce ion dissociation. Such ion dissociation has been described in Rockwood, A. L. et al., Rapid Commun. Mass Spectrom. 1991, vol. 5, pp. 582–585, the entire contents of which are incorporated herein by reference.

Figure 6:
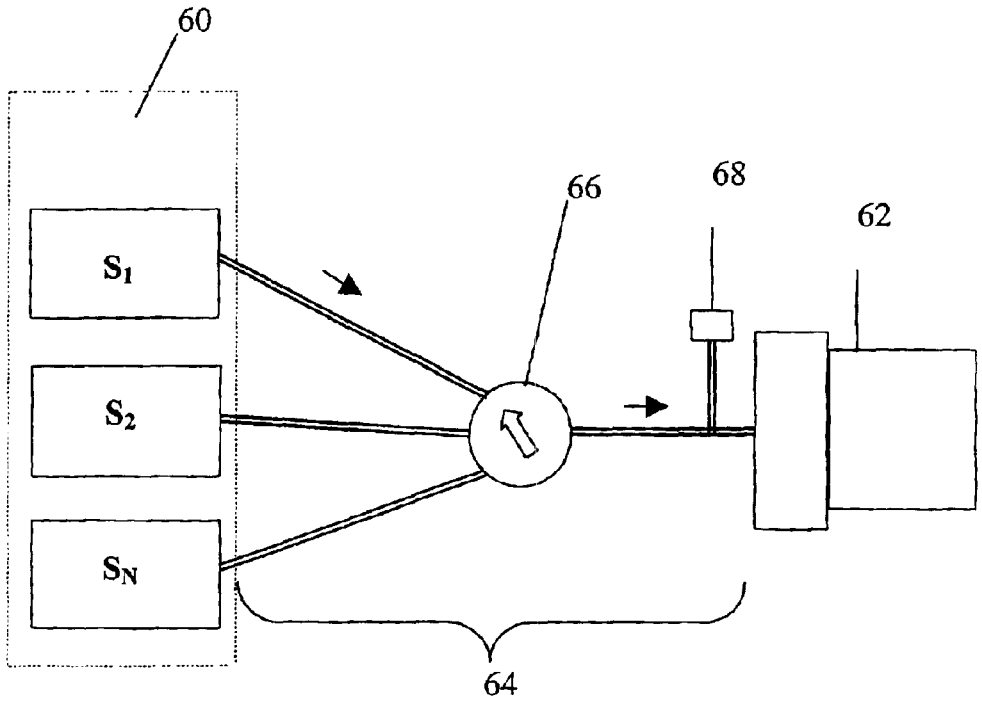
FIG. 6 is a schematic of a branched CIDD according to another embodiment of the present invention utilizing a gas switch to connect several ion sources to a MS instrument.

In addition, the CIDD of the present invention provides an interface between different ion sources and a single mass spectrometer instrument. As shown in FIG. 6, ion sources S1, S2, and SN can be interfaced to a single MS instrument 62. Optionally, the ion sources can be contained in an enclosure 60. The enclosure 60 can contain ambient gasses or be filled with a bath gas whose composition is different than the gas composition of ambient air. A switched capillary CIDD manifold 64 connects to the mass spectrometer 62 between ion sources S1, S2, and SN through a gas switch 66, permitting switching between individual sources S1, S2, and SN in less than a second. As a result, throughput to the mass spectrometer 62 can be increased. In this embodiment, ions are transported in a gas flow through the capillary manifold 64 such that the gas switch 66 directs gas flow from at least one of the ion sources S1, S2, and SN to the mass spectrometer 62. In another embodiment, a depressurizing device 68, such as for example a pressure-check valve or a vent tube, can be used, according to one embodiment of the present invention to control a pressure at the inlet orifice 2 or 3 of the mass spectrometer to near atmospheric pressure.

Figure 7:
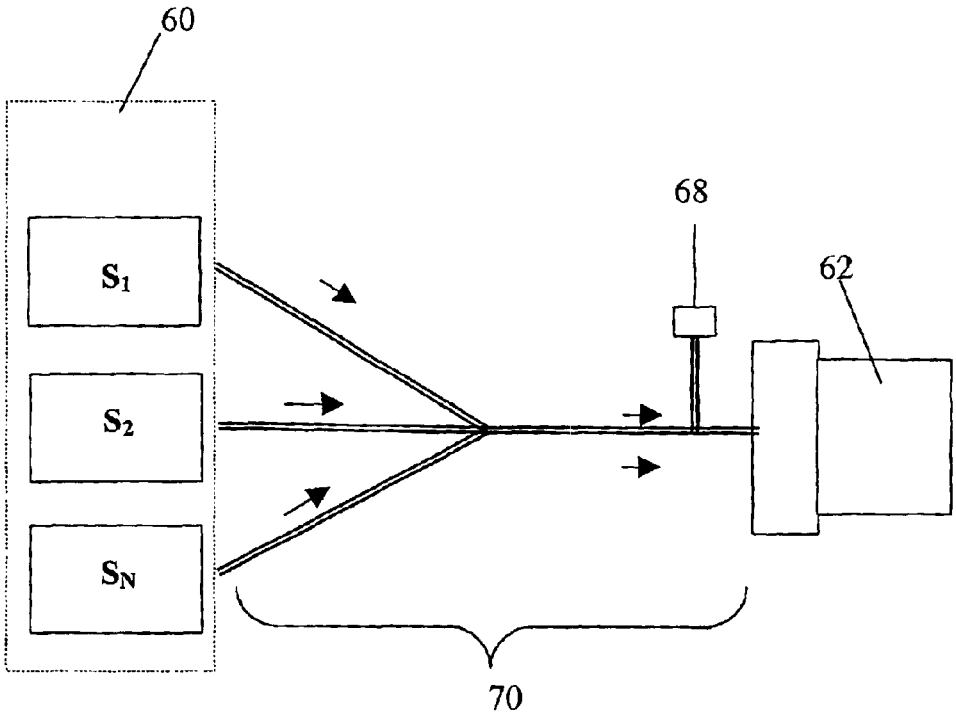
FIG. 7 is a schematic of a branched CIDD according to another embodiment of the present invention which mixes gas/ion streams produced by several Ion/Gas Sources and delivers the gas/ion streams to a MS instrument.

In another configuration, as shown in FIG. 7, a branched transport capillary CIDD 70 mixes ions from several ion sources S1, S2, and SN before the mixed ions are introduced to the mass spectrometer 62. Mixing of ions in a capillary device has been described by R. R. Loo et al. in J. Am. Soc. Mass Spectrom. 1992, vol. 3, pp. 695–705, the entire contents of which are incorporated herein by reference.

Another embodiment of the CIDD according to the present invention includes delivery of calibrant ions along with analyte ions from the different ion sources. Ion sources of different polarities originating from the different ion sources can be mixed, according to the present invention, with neutral gas phase reagents to induce various chemical reactions. The study of such reactions can provide information about analyte chemistry.

The process of partial neutralization in the CIDD of the present invention from multiply charged electrospray ions inside a branched CIDD is an attractive alternative to previous ion charge control techniques which required utilization of radioactive materials, as described by M. Sealf et al. in Science vol. 283, 1999, pp. 194–197, the entire contents of which are incorporated herein by reference.

Figure 8:
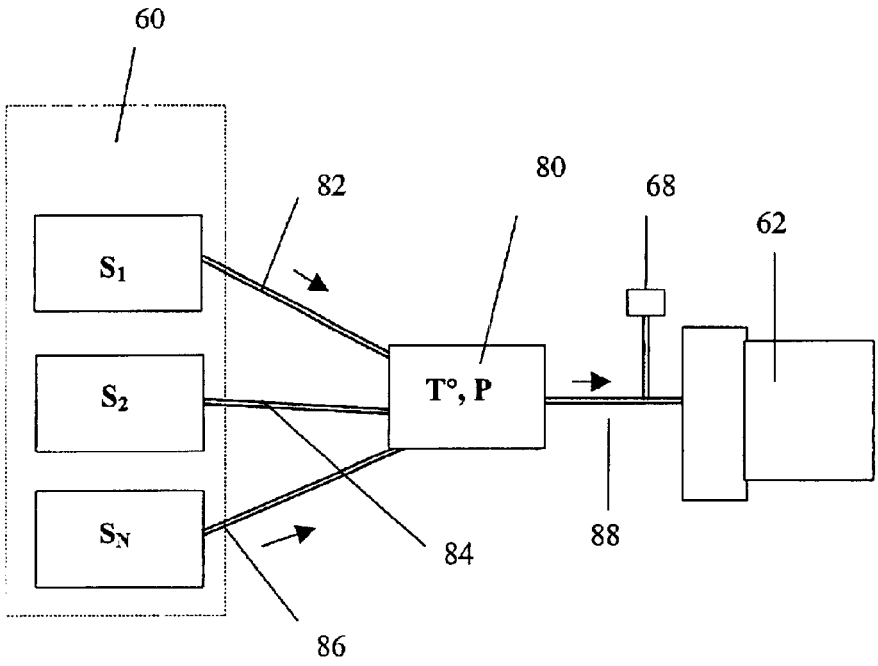
FIG. 8 is a schematic of an ion delivery system in which a branched CIDD according to another embodiment of the present invention delivers various ions and reaction gases to a reaction chamber prior to delivery to the MS instrument.

FIG. 8 illustrates a reaction chamber 80 of the present invention for effective and controllable mixing of ions prior to mass analysis. A reaction chamber 80, according to the present invention, can be a continuous flow reaction chamber composed of or lined with chemically materials such as for example teflon, stainless steel, or glass. The volume of the reaction chamber 80 can exceed the total volume of the branched transport capillary CIDD 70 by at least an order of magnitude so that a residence time of a reagent in the reaction chamber 80 is large compared to transit time through the branched transport capillary CIDD 70. In the reaction chamber 80, reaction conditions such as for example pressure, temperature, and reaction time are known, and the reaction kinetics can be calculated. The reaction chamber 80 is installed between branches channel capillary tubes 82, 84, and 86 and a core capillary 88 which introduces ions to a mass spectrometer. The core capillary 88 and the channel capillary tubes 82, 84, and 86 are fabricated consistent with the CIDD 14 to have appropriate inner diameters and interfacing to the mass spectrometer. Ions and reaction gases generated by various sources S1, S2, and SN, for example, are mixed in the reaction chamber 80 under controlled temperature and pressure conditions, and chemically reacted in a predetermined time established by the gas flow and volume of the reaction chamber 80. Depending on a particular reaction to be studied, the pressure, temperature, and gas flow rate inside the reaction chamber 80 can be adjusted so that a measurable amount of reagent material converts to a product during the residence time in the reaction chamber. Resultant products from the reaction chamber are introduced into the mass spectrometer 62 through the core capillary 88. Studies of the reacted products yield determinative information about the chemical identity of the ions.

Figure 9:
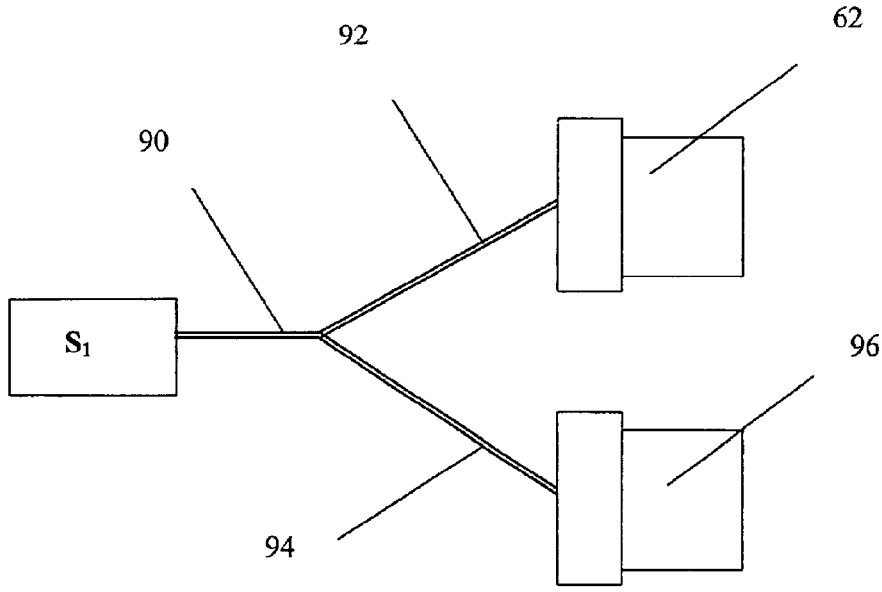
FIG. 9 is a schematic of an ion delivery system in which a branched CIDD according to another embodiment of the present invention delivers ions to multiple mass spectrometers.

In another embodiment of the present invention, the CIDD of the present invention is a branched capillary ion delivery device which delivers ions to multiple mass spectrometers, as shown in FIG. 9. FIG. 9 depicts a source capillary tube 90 branched multiple channel capillary tubes 92 and 94 branching to multiple mass spectrometers 62 and 96 such that a source such as $S_1$ is feed to either of the mass spectrometers.

Thus, the present invention involves a system for mass spectrometry including at least one ion source (e.g., S1, S2, and SN) which produces ions under an ambient pressure environment, a mass spectrometer (e.g. 62) having an inlet orifice (e.g. 3 or 7), and a capillary ion delivery device (e.g. 14, 64, or 70) which detachably interfaces to the inlet orifice of the mass spectrometer. The capillary ion delivery device can include at least one channel capillary tube (e.g. 82, 84, or 86) with an inlet port which accepts ions from the ion source, an union member (e.g. 66, 80) connected to the channel capillary tube, a core capillary tube (e.g. 88) connected to the union member, a connection port (e.g. 17) connected to the core capillary tube, and a sealing mechanism (e.g. 18) which permits the connection port to seal to the inlet orifice of the mass spectrometer.

The channel capillary tube (e.g. 82, 84, or 86) and the core capillary tube (e.g. 88) can have an inner diameter about 1.5 times an inner diameter of the inlet orifice of the mass spectrometer or in a preferred embodiment between 1.5 and 5 times the inner diameter of the inlet orifice of the mass spectrometer. In another embodiment according the present invention, the capillary ion delivery device (e.g. 14, 64, or 70) can have a total length between the ion source and the inlet orifice of the mass spectrometer about 10–100 times an inner diameter of the inlet orifice.

The channel capillary tube and the core capillary tube can be a metallic tube or an insulating tube. The insulating tube permits an electrical potential on an inlet side of the insulating tube to be different from an electric potential on an outlet side of the insulating tube. The channel capillary tube and the core capillary tube can be a flexible tube. The channel capillary tube and the core capillary tube can be a heated capillary tube. The capillary ion delivery device can support a temperature differential or a pressure differential along a longitudinal direction of the channel capillary tube and the core capillary tube. The pressure differential maintains a higher pressure at the inlet port of the capillary ion device such that ions are transported from the inlet port to the inlet orifice of the mass spectrometer by a gas dynamic motion of an ambient gas in the capillary ion delivery device. As such, the inlet port of the channel capillary tube can be pressurized and the connection port can be depressurized by way of the depressurization device 68.

The union member (e.g. 66, 80), according to the present invention, can branch to connect to the ion sources to the mass spectrometer and one of the ion sources (e.g. $S_2$) can be replaced with a reagent gas reservoir The union member can include a gas switch (e.g., 66) connected to at least one of the channel capillary tubes to distribute a gas flow to the core capillary tube. In another embodiment of the present invention, the union member can include a reaction vessel (e.g. 80) connected between the at least one channel capillary tube and the core capillary tube. The reaction vessel, according to the present invention, is maintained at a predetermined temperature and pressure. In another embodiment of the present invention, the union member as shown in FIG. 9 can also branch so that multiple mass spectrometers are simultaneously connected to a single ion delivery device.

The ion sources of the present invention (e.g, S1, S2, and SN) can be an electrospray ion source or an atmospheric pressure matrix-assisted laser desorption/ionization ion source. The ion source can be located in an enclosure (e.g. 60) filled by a bath gas of a composition different from a composition of ambient air.

The capillary ion delivery device of the present invention can detachably interface to a capillary tube (e.g. 2) or a pinhole orifice (e.g. 3) serving as the inlet orifice to the mass spectrometer. The inlet orifice of the mass spectrometer can further be a heated capillary tube.

Figure 10:
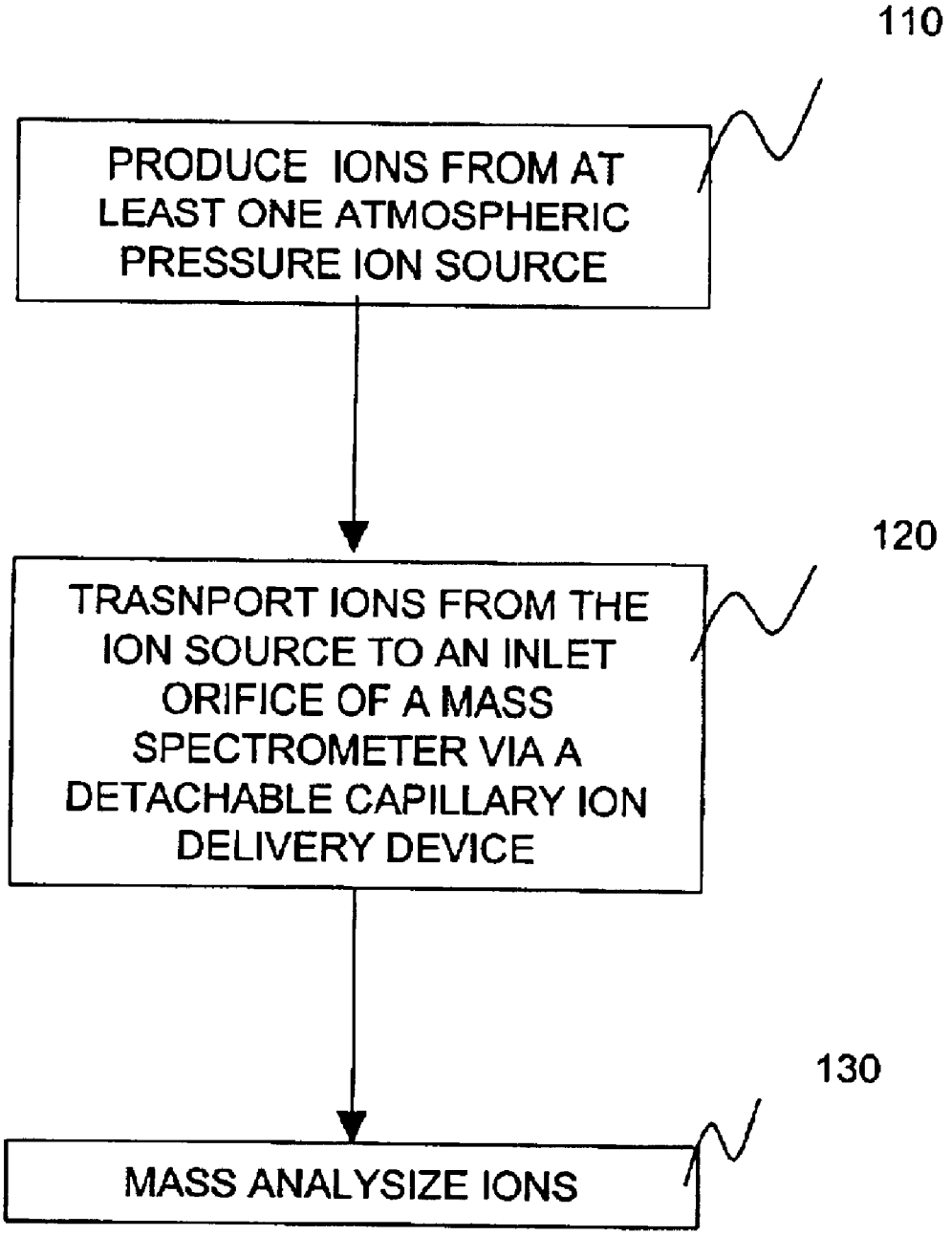
FIG. 10 is a flow chart illustrating a method for mass spectroscopy involving a CIDD according to one embodiment of the present invention.

FIG. 10 is a flow chart according to the present invention illustrating a method for mass spectroscopy involving a CIDD according to the present invention. According to the present invention, a method for mass spectrometry includes as shown at step 110 producing ions from at least one ion source, at step 120, transporting ions from at least one ion source to an inlet orifice of a mass spectrometer via a capillary ion delivery which detachably interfaces to the inlet orifice, and at step 130 mass analyzing the ions in the mass spectrometer.

The step of producing ions at step 110 can include producing ions from at least one of an electrospray ion source and an atmospheric pressure matrix-assisted laser desorption/ionization ion source.

The step of transporting the ions at step 120 can include controlling a first electrical potential on an inlet side of the capillary ion delivery device, and maintaining a second electrical potential which is different from the first electric potential on an outlet side of the capillary ion delivery device.

In another embodiment of the present invention, the step of transporting the ions at step 120 can include maintaining a pressure differential between an inlet port of the capillary ion delivery device and the inlet orifice of the mass spectrometer such that the ions are transported by a gas dynamic motion of an ambient gas in the capillary ion delivery device. The step of transporting the ions at step 120 can include pressurizing an inlet side of the capillary ion delivery device and depressurizing an outlet side of the capillary ion delivery device near the inlet orifice of the mass spectrometer. The step of transporting the ions at step 120 can include transporting the ions along with a bath gas of a composition different from a composition of ambient air.

In another embodiment of the present invention, the step of transporting the ions at step 120 can include switching a gas flow with a gas switch integral to the capillary ion delivery device and directing the gas flow from the at least one ion source to the inlet orifice of the mass spectrometer.

In another embodiment of the present invention, the step of transporting the ions at step 120 can include controlling a temperature and a pressure of the ions in a reaction vessel integral to the capillary ion delivery device.

The step of mass-analyzing the ions at step 130 can include mass-analyzing the ions in at least one of a time-of-flight mass spectrometer, an ion trap mass spectrometer, an rf quadrupole mass spectrometer, an ion cyclotron resonance mass spectrometer, and a magnetic sector mass spectrometer.

Numerous modifications and variations of the present invention are possible in light of the above teachings. It is therefore to be understood that within the scope of the appended claims, the invention may be practiced otherwise than as specifically described herein.

What is claimed as new and desired to be secured by Letters Patents of the United States is:

1. An ion delivery device for delivery of ions to an inlet orifice of a mass spectrometer, comprising:

an inlet port configured to accept ions from at least one of an ion source;

a capillary tube connected to said inlet port;

a connection port connected to the capillary tube and configured to detachably interface to said inlet orifice of the mass spectrometer; and a sealing mechanism configured to seal the connection port to the inlet orifice of said mass spectrometer.

2. The device as in claim 1, wherein the capillary has an inner diameter about 1.5 times an inner diameter of said inlet orifice of said mass spectrometer.

3. The device as in claim 2, wherein the capillary has an inner diameter between 1.5–5 times an inner diameter of said inlet orifice of said mass spectrometer.

4. The device as in claim 1, wherein the capillary tube has a length at least 10 times an inner diameter of said inlet orifice.

5. The device as in claim 1, wherein the capillary tube comprises a metallic tube.

6. The device as in claim 1, wherein the capillary tube comprises an insulating tube.

7. The device as in claim 6, further comprising:

an inlet flange configured to maintain an electric potential and to provide a gas flow sufficient to prevent uncharged droplets from reaching an entrance to the insulating tube.

8. The device as in claim 1, wherein the capillary tube comprises a flexible tube.

9. The device as in claim 1, wherein the capillary tube comprises a heated capillary tube.

10. The device as in claim 1, wherein the capillary tube is configured to support a temperature differential.

11. The device as in claim 1, wherein the capillary tube is configured to support a pressure differential along a longitudinal direction of said capillary tube.

12. The device as in claim 10, wherein the inlet port is configured to be pressurized and the capillary tube includes:

a depressurizing device configured to depressurize the capillary tube near the connection port to atmospheric pressure.

13. The device as in claim 1, wherein the sealing mechanism comprises:

a flange; and an O-ring seal.

14. The device as in claim 13, wherein the flange is a stainless steel flange.

15. The device as in claim 13, wherein the o-ring seal is a teflon o-ring seal.

16. A system for mass spectrometry, comprising:

at least one ion source configured to produce ions;

a mass spectrometer having an inlet orifice configured to accept the ions; and a capillary ion delivery device configured to detachably interface to and maintain near standard pressure and temperature conditions at said inlet orifice of the mass spectrometer.

17. The system as in claim 16, wherein the capillary ion delivery device comprises:

at least one channel capillary tube including an inlet port configured to accept and transport the ions from the at least one ion source;

an union member connected to the at least one channel capillary tube;

a core capillary tube connected to said union member;

a connection port connected to said core capillary tube and; and a sealing mechanism configured to seal the connection port to seal to the inlet orifice of said mass spectrometer.

18. The system as in claim 17, wherein the channel capillary tube and the core capillary tube have an inner diameter about 1.5–5 times an inner diameter of said inlet orifice of said mass spectrometer.

19. The system as in claim 17, wherein the capillary ion delivery device has a total length between said at least one ion source and the inlet orifice of the mass spectrometer at least 10 times an inner diameter of said inlet orifice.

20. The system as in claim 17, wherein at least one of the channel capillary tube and the core capillary tube comprises a metallic tube.

21. The system as in claim 17, wherein at least one of the channel capillary tube and the core capillary tube comprises an insulating tube.

22. The system as in claim 21, further comprising:

an inlet flange configured to maintain an electric potential and to provide a gas flow sufficient to prevent uncharged droplets from reaching an entrance to the insulating tube.

23. The system as in claim 17, wherein the channel capillary tube and the core capillary tube comprise a flexible tube.

24. The system as in claim 17, wherein at least one of the channel capillary tube and the core capillary tube comprises a heated capillary tube.

25. The system as in claim 17, wherein the capillary ion delivery device is configured to support a temperature differential.

26. The system as in claim 17, wherein the capillary ion delivery device is configured to support a pressure differential along a longitudinal direction of said capillary ion delivery device.

27. The system as in claim 26, wherein the inlet port is configured to be pressurized and the capillary tube includes:

a depressurizing device configured to depressurize the capillary tube near the connection port to atmospheric pressure.

28. The system according to claim 17, wherein the union member branches to connect to the mass spectrometer said at least one ion source and a reagent gas reservoir.

29. The system according to claim 17, wherein the union member branches so that multiple mass spectrometers are connected to a single ion delivery device.

30. The system according to claim 17, wherein the union member comprises:

a gas switch connected to at least one of said channel capillary tubes and configured to distribute a gas flow to the core capillary tube.

31. The system according to claim 17, wherein the union member comprises:

a reaction vessel connected between said at least one channel and said core capillary tube, said reaction vessel configured to control at a predetermined temperature and pressure.

32. The system as in claim 16, wherein said at least one ion source comprises:

at least one of an electrospray ion source and an atmospheric pressure matrix-assisted laser desorption/ionization ion source.

33. The system as in claim 16, further comprising:

an enclosure including said at least one ion source, wherein the enclosure is filled by a bath gas of a composition different from a composition of ambient air.

34. The system as in claim 16, wherein the inlet orifice of the mass spectrometer comprises:

a pinhole orifice.

35. The system as in claim 16, wherein the inlet orifice of the mass spectrometer comprises:

a capillary tube.

36. The system as in claim 16, wherein the inlet orifice of the mass spectrometer comprises:

a heated capillary tube.

37. The system as in claim 16, wherein the mass spectrometer comprises:

at least one of a time-of-flight mass spectrometer, an ion trap mass spectrometer, an rf quadrupole mass spectrometer, an ion cyclotron resonance mass spectrometer, and a magnetic sector mass spectrometer.

38. A method for mass spectrometry, comprising:

producing ions from at least one ion source;

transporting said ions from the at least one ion source to an inlet orifice of a mass spectrometer via a capillary ion delivery device configured to detachably interface to and maintain near standard pressure and temperature conditions at said inlet orifice of the mass spectrometer; and mass analyzing said ions in said mass spectrometer.

39. The method as in claim 38, wherein the step of producing comprises:

producing ions from at least one of an electrospray ion source and an atmospheric pressure matrix-assisted laser desorption/ionization ion source.

40. The method as in claim 38, wherein the step of transporting comprises:

controlling a first electrical potential on an inlet side of the capillary ion delivery device; and maintaining a second electrical potential which is different from the first electric potential on an outlet side of the capillary ion delivery device.

41. The method as in claim 38, wherein the step of transporting comprises:

maintaining a pressure differential between an inlet port of said capillary ion delivery device and the inlet orifice of said mass spectrometer such that said ions are transported by a gas dynamic motion of an ambient gas in said capillary ion delivery device.

42. The method as in claim 41, wherein the step of maintaining a pressure differential comprises at least one of the steps of:

pressurizing an inlet side of the capillary ion delivery device; and depressurizing an outlet side of the capillary ion delivery device near said inlet orifice of the mass spectrometer.

43. The method as in claim 38, wherein the step of transporting comprises:

transporting said ions along with a bath gas of a composition different from a composition of ambient air.

44. The method as in claim 38, wherein the step of transporting comprises:

switching a gas flow with a gas switch integral to the capillary ion delivery device; and directing the gas flow from the at least one ion source to the inlet orifice of the mass spectrometer.

45. The method as in claim 38, wherein the step of transporting comprises:

controlling a temperature and a pressure of said ions in a reaction vessel integral to said capillary ion delivery device.

46. The method as in claim 42, wherein the step of mass analyzing said ions comprises:

mass-analyzing said ions in at least one of a time-of-flight mass spectrometer, an ion trap mass spectrometer, an rf quadrupole mass spectrometer, an ion cyclotron resonance mass spectrometer, and a magnetic sector mass spectrometer.

47. A system for mass spectrometry, comprising:

means for producing ions from at least one ion source;

means for transporting said ions from at least one ion source to an inlet orifice of a mass spectrometer via a capillary ion delivery device configured to detachably interface to and maintain near standard pressure and temperature conditions at said inlet orifice of the mass spectrometer; and means for mass analyzing the ions in said mass spectrometer.

48. The system as in claim 47, wherein the means for producing comprises:

means for producing ions from at least one of an electrospray ion source and an atmospheric pressure matrix-assisted laser desorption/ionization ion source.

49. The system as in claim 47, wherein the means for transporting comprises:

means for controlling a first electrical potential on an inlet side of the capillary ion delivery device; and means for maintaining a second electrical potential which is different from the first electric potential on an outlet side of the capillary ion delivery device.

50. The system as in claim 47, wherein the means for transporting comprises:

means for maintaining a pressure differential between an inlet port of said capillary ion delivery device and the inlet orifice of said mass spectrometer such that said ions are transported by a gas dynamic motion of an ambient gas in said capillary ion delivery device.

51. The system as in claim 50, wherein the means for maintaining a pressure differential comprises at least one of:

means for pressurizing an inlet side of the capillary ion delivery device; and means for depressurizing an outlet side of the capillary ion delivery device near said inlet orifice of the mass spectrometer.

52. The system as in claim 47, wherein the means for transporting comprises:

means for transporting said ions along with a bath gas of a composition different from a composition of ambient air.

53. The system as in claim 47, wherein the means for transporting comprises:

means for switching a gas flow with a gas switch integral to the capillary ion delivery device; and directing the gas flow from the at least one ion source to the inlet orifice of the mass spectrometer.

54. The system as in claim 47, wherein the means for transporting comprises:

means for controlling a temperature and a pressure of said ions in a reaction vessel integral to said capillary ion delivery device.

55. The system as in claim 47, wherein the means for mass analyzing said ions comprises:

means for mass-analyzing said ions in at least one of a time-of-flight mass spectrometer, an ion trap mass spectrometer, an rf quadrupole mass spectrometer, and a magnetic sector mass spectrometer.

* * * * *